US006028559A

United States Patent [19]

Satoh et al.

[11] Patent Number: 6,028,559

[45] Date of Patent: Feb. 22, 2000

[54] LOOP ANTENNA

[75] Inventors: Kenichi Satoh, Sendai; Nobutaka Mochizuki, Yokohama, both of Japan

[73] Assignee: Matsushita Electric Industrial Co., Ltd., Osaka, Japan

[21] Appl. No.: 09/055,313

[22] Filed: Apr. 6, 1998

[30] Foreign Application Priority Data

Apr. 25, 1997 [JP] Japan ..... 9-121484

[51] Int. Cl.[7] ..... H01Q 11/12

[52] U.S. Cl. ..... 343/744; 343/742; 343/866

[58] Field of Search ..... 343/741, 742, 343/744, 788, 855, 860, 866, 867; H01Q 11/12

[56] References Cited

U.S. PATENT DOCUMENTS

| | | | |
|---|---|---|---|
| 4,117,491 | 9/1978 | Hanna et al. | 343/742 |
| 4,725,780 | 2/1988 | Yoda et al. | 343/744 |
| 5,422,650 | 6/1995 | Hill | 343/744 |
| 5,493,312 | 2/1996 | Knebelkamp | 343/860 |
| 5,663,738 | 9/1997 | Mueller | 343/742 |

FOREIGN PATENT DOCUMENTS

| | | |
|---|---|---|
| 3113901 | 5/1991 | Japan . |
| 4014304 | 1/1992 | Japan . |
| 50222017 | 1/1993 | Japan . |

*Primary Examiner*—Don Wong
*Assistant Examiner*—Tho Phan
*Attorney, Agent, or Firm*—Pollock, Vande Sande & Amernick

[57] ABSTRACT

A first loop antenna apparatus is disclosed which includes an open loop antenna portion and an inductor having a predetermined inductance and first and second ends connected to first and second intermediate points of the open loop antenna portion. The inductance of the first loop antenna apparatus is decreased because the inductor is connected in parallel, so that an opening area (antenna gain) is increased at the same resonant condition. A second loop antenna apparatus is also disclosed which includes an open loop antenna portion, a first inductor having a predetermined inductance, one end of the first inductor being connected to first intermediate point of the open loop antenna portion, a second inductor having the predetermined inductance, one end of the second inductor being connected to a second intermediate point of the open loop antenna portion, and a capacitor having a predetermined capacitance, connected the other ends of the first and second inductors. Similarly, the inductance of the second loop antenna apparatus is decreased because the inductors and the capacitor is connected in parallel, so that an opening area (antenna gain) is increased at the same resonant condition.

6 Claims, 4 Drawing Sheets

LOOP ANTENNA

BACKGROUND OF THE INVENTION

1. Field of the Invention

This invention relates to a loop antenna apparatus.

2. Description of the Prior Art

A loop antenna apparatus for receiving or transmitting a radio wave signal is known. FIG. 7 is a plan view of a prior art loop antenna apparatus and FIG. 8 is an equivalent circuit diagram of the prior art loop antenna apparatus shown in FIG. 7. The prior art loop antenna comprises a first loop antenna element 101*a*, a second loop antenna element 101*b* and a capacitor 104 connected between the first and second loop antenna elements 101*a* and 101*b*. The prior art loop antenna apparatus is connected to an impedance matching circuit 3 for inputting or outputting.

SUMMARY OF THE INVENTION

The aim of the present invention is to provide a superior loop antenna apparatus.

According to the present invention, a first antenna apparatus is provided which includes an open loop antenna portion, and an inductor having a predetermined inductance and first and second ends connected to first and second intermediate points of the open loop antenna portion, a first portion of the open loop antenna portion between the irst and second intermediate points and the inductor forming a loop and second and third portions of the open loop antenna portion other than the first portion and the inductor forming an open loop, one and the other end of the open loop antenna portion having feeding points.

In the first antenna apparatus, a longitudinal dimension of the second portion may be $\lambda/8$–$3\lambda/8$, wherein $\lambda$ is a wavelength provided by oscillation of the first antenna apparatus. Moreover, the longitudinal dimension of the second portion may more favorable be $3\lambda/16$–$5\lambda/16$. Further, the longitudinal dimension of the second portion is more favorably substantially $\lambda/4$.

According to the present invention, a second antenna apparatus is provided which includes an open loop antenna portion, and a first inductor having a predetermined inductance, one end of the first inductor being connected to first intermediate point of the open loop antenna portion, a second inductor having the predetermined inductance, one end of the second inductor being connected to a second intermediate point of the open loop antenna portion, and a capacitor having a predetermined capacitance, connected to the other ends of the first and second inductors, a first portion of the open loop antenna portion between the first and second intermediate points, the first and second inductors, and the capacitor forming a loop and second and third portions of the open loop antenna portion other than the first portion, the first and second inductors, and the capacitor forming an open loop, the ends of the open loop antenna portion having feeding points.

The second antenna apparatus may further include a substrate, wherein the first and second inductors include printed circuit patterns, one ends of the printed circuit patterns are connected to the open loop antenna portion at the first and second intermediate points and the capacitor is provided by the other ends of the printed circuit patterns and the space therebetween.

BRIEF DESCRIPTION OF THE DRAWINGS

The object and features of the present invention will become more readily apparent from the following detailed description taken in conjunction with the accompanying drawings in which.

The same or corresponding elements or parts are designated with like references throughout the drawings.

DETAILED DESCRIPTION OF THE INVENTION

Hereinbelow will be described a first embodiment of this invention.

Figure 1:
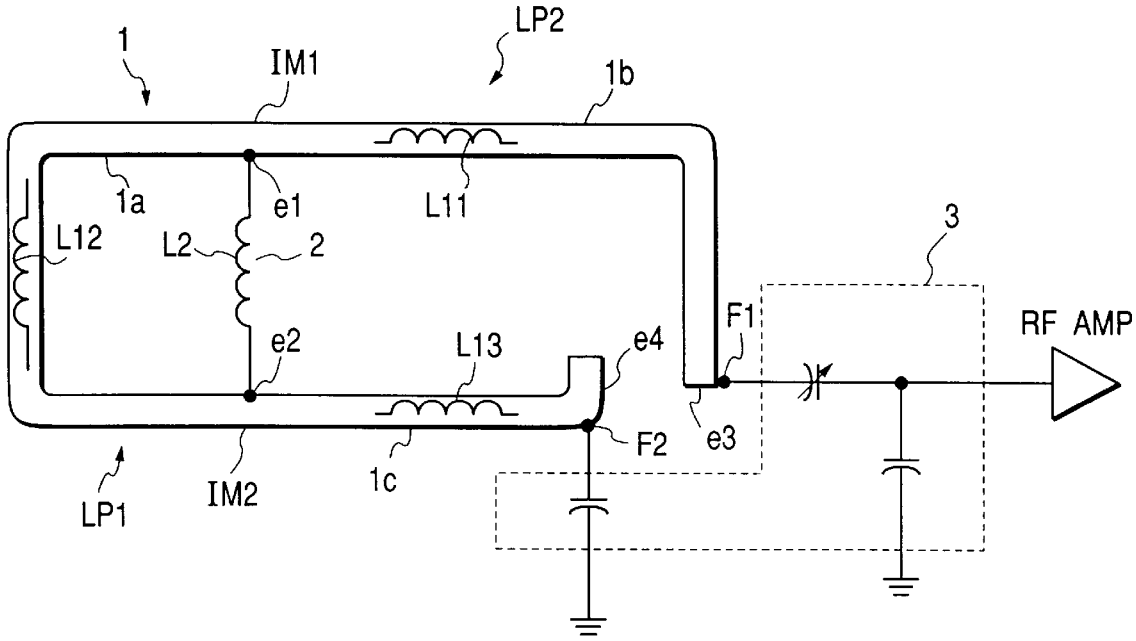
FIG. 1 is a plan view of a loop antenna apparatus of the first embodiment.

FIG. 1 is a plan view of a loop antenna apparatus of the first embodiment.

The loop antenna apparatus of the first embodiment includes an open loop antenna portion 1 having an inductance L1; and an inductor 2 having a predetermined inductance L2, its first and second ends e1 and e2 being connected to first and second intermediate points IM1 and IM2 of the open loop antenna portion 1 respectively, a first portion 1*a* of the open loop antenna portion 1 between the first and second intermediate points IM1 and IM2 and the inductor 2 forming a loop LP1 and second and third portions 1*b* and 1*c* of the open loop antenna portion 1 other than the first portion 1*a* and the inductor 2 forming an open loop LP2, the ends e3 and e4 of the open loop antenna portion 1 having feeding points F1 and F2.

The open loop antenna portion 1 has the inductance L1, for example, 40 nH, which is higher than that for the desired frequency, for example, 900 MHz if the inductor 2 is not connected. The inductor 2 having an inductance L2, for example, 10 nH reduces inductances of the open loop antenna of the first embodiment because the inductor 2 is connected to the open loop antenna portion 1 in parallel. Therefore, the frequency at the resonant condition is increased without changing the total opening areas of this loop antenna apparatus. In other words, the gain of the loop antenna apparatus is higher than that of the conventional loop antenna having the same opening area.

Figure 2:
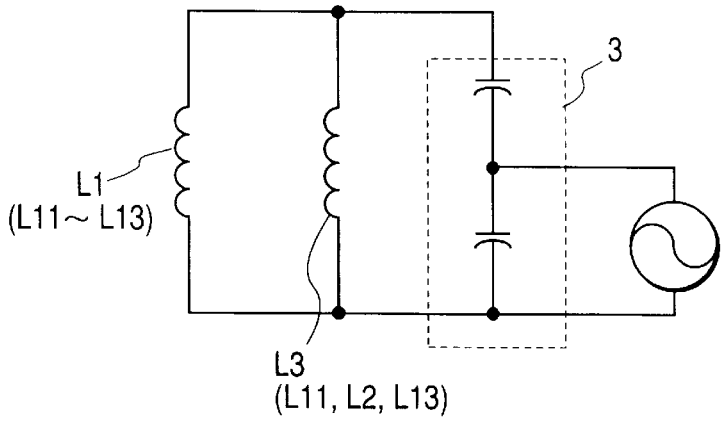
FIG. 2 is an equivalent circuit diagram of the loop antenna apparatus of the first embodiment.

FIG. 2 is an equivalent circuit diagram of the loop antenna apparatus of the first embodiment. The inductance of the loop antenna apparatus is decreased by providing the inductor 2 because an inductance L3 including L11, L2, and L13 is connected to the inductance L1 of the open loop antenna portion 1 in parallel.

Figure 3:
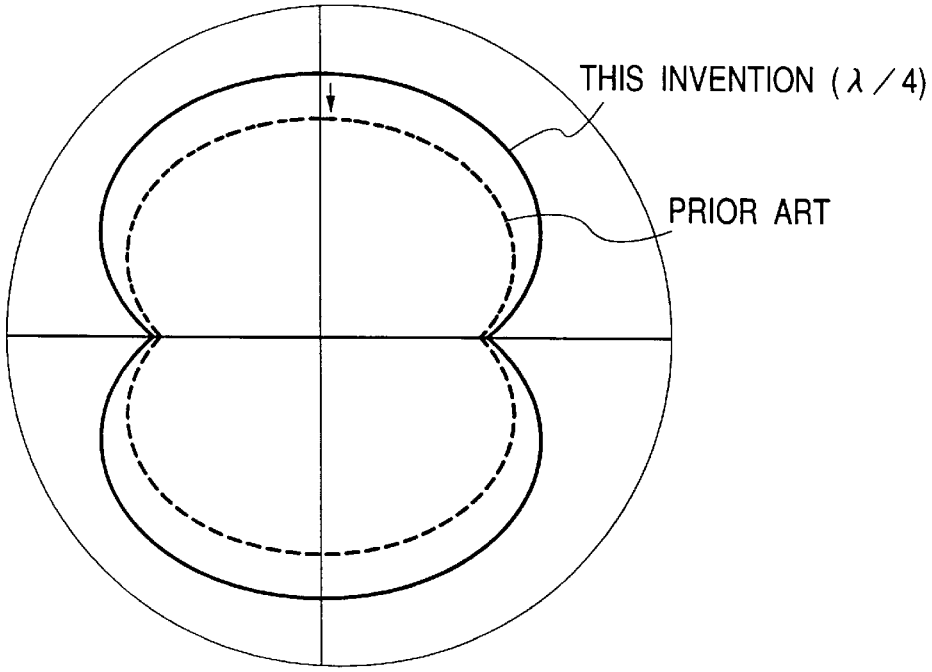
FIGS. 3 is a graphical drawing of the first embodiment showing a directivity of vertical polarizing waves at 900 MHz.
Figure 4:
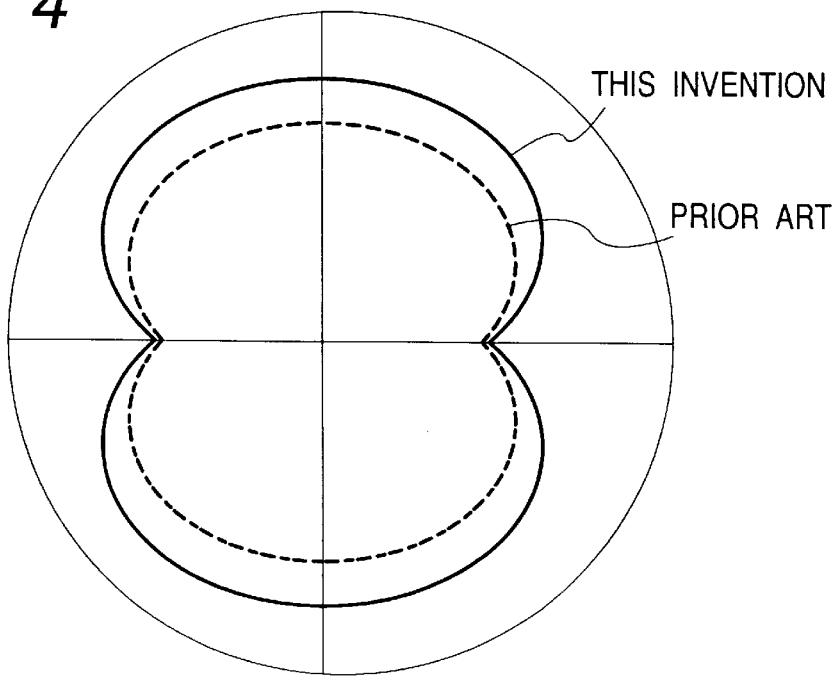
FIG. 4 is a graphical drawing of the first embodiment showing a directivity of horizontal polarizing waves.
Figure 7:
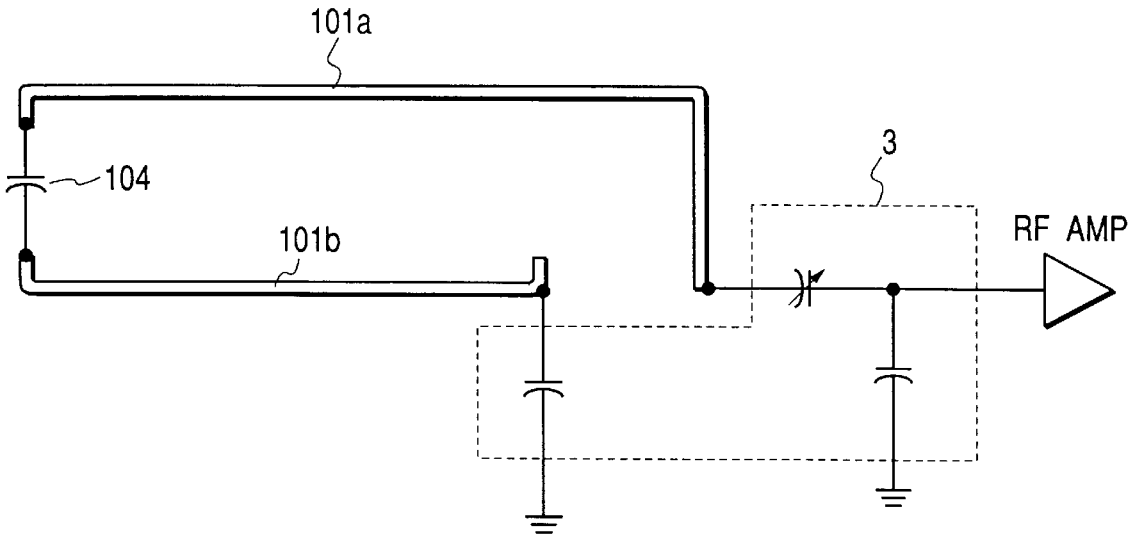
FIG. 7 PRIOR ART
FIG. 7 is a plan view of a prior art loop antenna apparatus.
Figure 8:
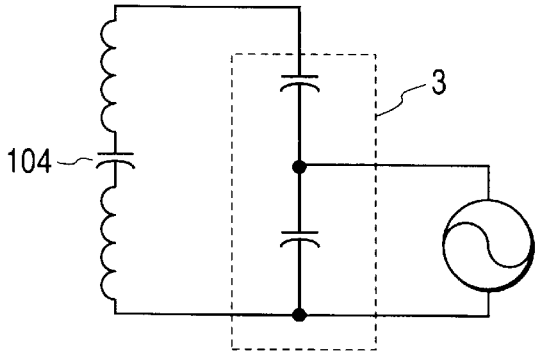
FIG. 8 PRIOR ART
FIG. 8 an equivalent circuit diagram of the prior art loop antenna apparatus shown in FIG. 7.

FIGS. 3 is a graphical drawing of the first embodiment showing a directivity of vertical polarizing waves at 900 MHz and FIG. 4 is a graphical drawing of the first embodiment showing directivities of horizontal polarizing waves, wherein directivity of vertical and horizontal of a prior art at 900 MHz provided by the loop antenna shown in FIGS. 7 and 8 are also shown.

In FIGS. 7 and 8, an antenna gain of the loop antenna of the first embodiment substantially −12 dB. On the other hand, the antenna gain of the prior art loop antenna shown in FIGS. 7 and 8 is substantially −15 dB, so that the loop antenna apparatus of the first embodiment has a higher antenna gain by 3 dB than that by the prior art loop antenna apparatus shown in FIGS. 7 and 8.

In the antenna apparatus of the first embodiment, a longitudinal dimension of the second portion 1b is favorable from λ/8 to 3λ/8 regarding the antenna gain, wherein λ is an wave length provided by the open loop antenna apparatus oscillates. Moreover, the longitudinal dimension of the second portion 1b is more favorable from 3λ/16 to 5λ/16. Further, the longitudinal dimension of the first portion is most favorable at substantially λ/4 with respect to the antenna gain as shown in FIGS. 3 and 4. That is, the antenna gain is gradually close to that of the prior art shown in FIG. 7 as the longitudinal dimension of the first portion is apart from λ/4 as shown by the arrow in FIG. 3.

As mentioned, the loop antenna apparatus of the first embodiment provides a higher frequency with a relative larger size of the loop antenna portion 1. In other words, a larger opening area is provided at the same frequency. That is, the antenna gain is improved. In this embodiment, the inductor is only one. However, it is also possible to provide a plurality of inductors connected in parallel.

A second embodiment will be described.

Figure 5:
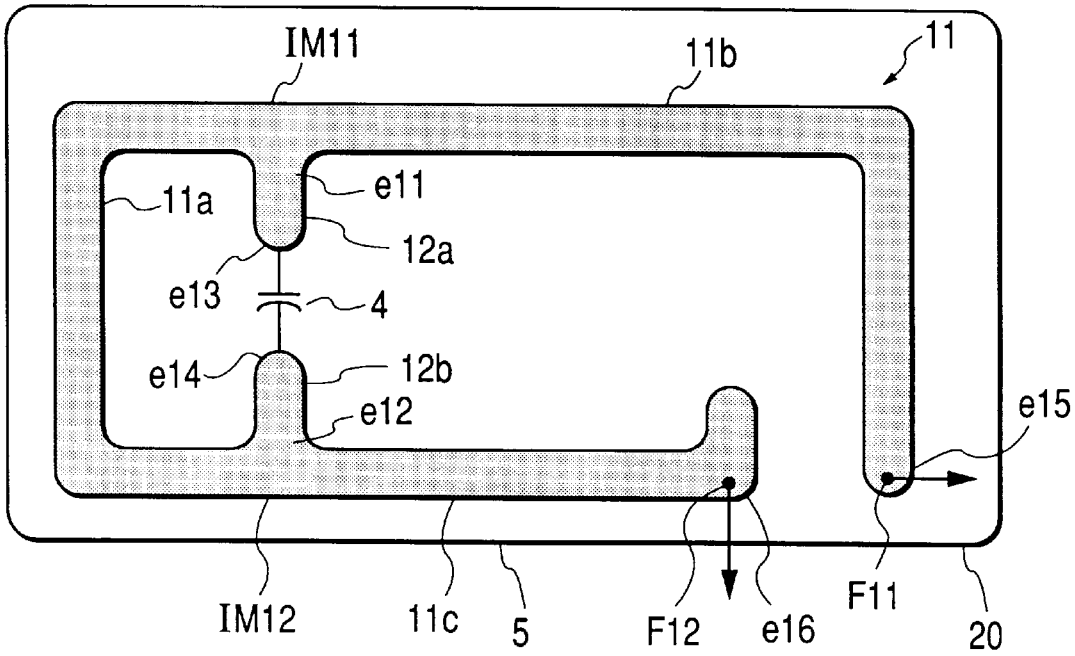
FIG. 5 is a plan view of a loop antenna apparatus of a second embodiment.

FIG. 5 is a plan view of a loop antenna apparatus of the second embodiment.

The loop antenna apparatus of the second embodiment includes a substrate 20, an open loop antenna portion 11 on the substrate 20; and a first inductor 12*a* on the substrate 20 having a predetermined inductance, one end e11 of the first inductor 12*a* being connected to a first intermediate point IM11 of the open loop antenna portion 11, a second inductor 12*b* having the predetermined inductance, one end el2 of the second inductor 12*b* being connected to a second intermediate point IM12 of the open loop antenna portion 11, and a capacitor 4 having a predetermined capacitance, connected the other ends e13 and e14 of the first and second inductors 12*a* and 12*b* respectively, a first portion 11*a* of the open loop antenna portion 11 between the first and second intermediate points IM11 and IM12, the first and second inductors 12*a* and 12*b*, and the capacitor 4 forming a loop and second and third portions 11*b* and 11*c* of the open loop antenna portion 11 other than the first portion 11*a*, the first and second inductors 12*a* and 12*b*, and the capacitor forming an open loop, one end e15 and the other end e16 of the open loop antenna portion 11 having feeding points F11 and F12.

The open loop antenna portion 11 is formed on the substrate 20 with a printed circuit pattern by etching. Further, the first and second inductors are provided with printed circuit patterns also, wherein one ends of the printed circuit patterns for the first and second inductors 12*a* and 12*b* are connected to the open loop antenna portion 11 at the first and second intermediate points IM11 and IM12 and the capacitor 4 is provided with the other ends e13 and e14 of the printed circuit patterns for the inductors 12*a* and 12*b* and the space therebetween.

Figure 6:
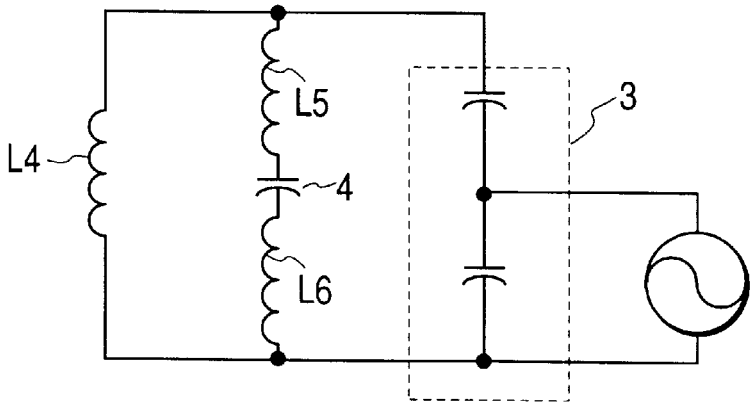
FIG. 6 is an equivalent circuit diagram of the loop antenna apparatus of the second embodiment.

FIG. 6 is an equivalent circuit diagram of the loop antenna apparatus of the second embodiment. The inductance of the loop antenna apparatus of the second embodiment is decreased by providing the parallel circuit including the inductors 12*a* and 12*b*, so that the inductance of the loop antenna apparatus of the second embodiment is lower than that without the inductors 12*a* and 12*b* and the capacitor 4.

That is, the resonant frequency becomes relatively high with the same opening area. In other words. the opening area is relatively large at the same resonant frequency, so that the antenna gain is increased. Moreover, the capacitor 4 diffuses potentials concentrated to the inductors 12*a* and 12*b*, so that a suitable characteristic is provided. In this embodiment, the parallel circuit including inductors 12*a* and 12*b* and the capacitor 4 is provided only one. However, it is also possible to provide a plurality of parallel circuits connected to the open loop portion 11 in parallel.

What is claimed is:

1. An antenna apparatus comprising:

an open loop antenna portion; and inductor means having a predetermined inductance and first and second ends connected to first and second intermediate points of said open loop antenna portion, a first portion of said open loop antenna portion between said first and second intermediate points and said inductor means forming a loop and second and third portions of said open loop antenna portion other than said first portion and said inductor means forming an open loop, one and the other end of said open loop antenna portion having feeding points, wherein said first and second ends are directly and physically connected to said first and second intermediate points of said open loop antenna portion.

2. The antenna apparatus as claimed in claim 1, wherein a longitudinal dimension of said second portion is λ/8–3λ/8, wherein λ is a wavelength provided by oscillation of said antenna apparatus.

3. The antenna apparatus as claimed in claim 2, wherein a longitudinal dimension of said second portion is 3λ/16–5λ/16.

4. The antenna apparatus as claimed in claim 3, wherein a longitudinal dimension of said second portion is substantially λ/4.

5. An antenna apparatus comprising:

an open loop antenna portion; and first inductor means having a predetermined inductance, one end of said first inductor means being connected to a first intermediate point of said open loop antenna portion;

second inductor means having said predetermined inductance, one end of said second inductor means being connected to a second intermediate point of said open loop antenna portion; and capacitive means having a predetermined capacitance, connected to the other ends of said first and second inductor means, a first portion of said open loop antenna portion between said first and second intermediate points, said first and second inductor means, and said capacitive means forming a loop and second and third portions of said open loop antenna portion other than said first portion, said first and second inductor means, and said capacitive means forming an open loop, one and the other end of said open loop antenna portion having feeding points, wherein said one end of said first inductor means is directly connected to said first intermediate point of said open loop antenna portion, said one end of said second inductor means is directly connected to said second intermediate point of said open loop antenna portion, and said capacitive means is directly and physically connected to the other ends of said first and second inductor means.

6. The antenna apparatus as, claimed in claim 5, further comprising a substrate, wherein said open loop antenna portion is on said substrate, said first and second inductor means comprise printed circuit patterns on said substrate, said printed circuit patterns each having one end connected to said open loop antenna portion at said first and second intermediate points, and said capacitive means is provided by the other end of each of said printed circuit patterns and a space therebetween.

* * * * *